US008814731B2

(12) United States Patent
Jennings

(10) Patent No.: US 8,814,731 B2
(45) Date of Patent: Aug. 26, 2014

(54) FLEXIBLE RACQUET HANDLE

(71) Applicant: Joseph Jennings, Sarasota, FL (US)

(72) Inventor: Joseph Jennings, Sarasota, FL (US)

( * ) Notice: Subject to any disclaimer, the term of this patent is extended or adjusted under 35 U.S.C. 154(b) by 0 days.

(21) Appl. No.: 13/778,885

(22) Filed: Feb. 27, 2013

(65) Prior Publication Data

US 2013/0331209 A1 Dec. 12, 2013

Related U.S. Application Data

(60) Provisional application No. 61/656,050, filed on Jun. 6, 2012.

(51) Int. Cl.
*A63B 7/02* (2006.01)
*A63B 49/02* (2006.01)
*A63B 49/00* (2006.01)

(52) U.S. Cl.
CPC ..... *A63B 49/00* (2013.01)
USPC ..... 473/549; 473/521; 473/527

(58) Field of Classification Search
USPC ..... 473/521, 524, 527, 531, 538, 549, 552
See application file for complete search history.

(56) References Cited

U.S. PATENT DOCUMENTS 335,656 A 2/1886 Taylor
1,985,427 A * 12/1934 Richardson ..... 403/223
3,341,202 A * 9/1967 Stars ..... 473/282
3,679,205 A 7/1972 Finkle et al.
4,367,871 A * 1/1983 Schiefer ..... 473/463
4,746,119 A 5/1988 Jeanrot
4,854,585 A 8/1989 Koch et al.
4,915,382 A 4/1990 Madsen
5,108,114 A 4/1992 Marx
5,143,373 A 9/1992 Meissner
5,178,387 A 1/1993 Kuebler
5,178,388 A 1/1993 Schlenker
5,560,600 A * 10/1996 FitzSimons et al. ..... 473/463
5,735,752 A * 4/1998 Antonious ..... 473/317
5,749,574 A * 5/1998 Curtis ..... 473/531
5,865,694 A * 2/1999 Duong-Van ..... 473/520
6,050,903 A * 4/2000 Lake ..... 473/244
6,257,992 B1 7/2001 LeBlanc
6,537,164 B1 * 3/2003 Hsu ..... 473/521
2004/0235583 A1 * 11/2004 Del Principe ..... 473/316

* cited by examiner

*Primary Examiner* — Nini Legesse
(74) *Attorney, Agent, or Firm* — Buckingham Doolittle & Burroughs, LLC

(57) ABSTRACT

An improved racquet handle, such as for a tennis or racquetball racquet, comprised of one or more flexible insert devices that add flexibility to said handle and create one or more pivot points along said handle. The increased flexibility of the racquet handle enables a user to impart greater force on a ball, such as a tennis ball, and also dampens or reduces the amount of vibration and/or shock otherwise imparted to the racquet user when the racquet strikes the ball. The structure of the improved racquet handle and the insert device(s) also permit the user to use the improved racquet handle with a plurality of interchangeable racquet heads.

8 Claims, 6 Drawing Sheets

FLEXIBLE RACQUET HANDLE

CROSS-REFERENCE

This application claims priority from Provisional Patent Application Ser. No. 61/656,050 filed on Jun. 6, 2012.

FIELD OF THE INVENTION

This invention relates to an improved racquet handle that enables the user to increase the force imparted on a ball, such as a tennis ball, by the racquet, while reducing the shock to the user resulting from the impact of the racquet striking the ball. More specifically, the improved racquet handle is comprised of at least one non-rigid insert that adds flexibility to the racquet handle and enables the user to apply more force to the ball when swinging the racquet, while also reducing the amount of shock imparted to the individual when the racquet makes contact with the ball. The flexible racquet handle is relatively easy to use, inexpensive to manufacture, and can be used in conjunction with a variety of racquets, such as tennis racquets, racquet ball racquets, badminton racquets and the like.

BACKGROUND

Many individuals enjoy racquet based sports such as tennis, racquetball, badminton and the like. Traditional racquet designs are typically constructed of rigid, hollow or solid handles and posts, which are oftentimes comprised of wood, plastic, fiberglass and the like. However, because these prior art designs are relatively rigid, a vibration or shock tends to travel down the racquet handle and to the user when the racquet is used to strike an object such as a ball. Therefore, individuals may not be able to strike the ball very hard, especially if the individual is new to the sport and/or does not possess good form when swinging the racquet. This may be frustrating for the individual, and discourage the individual from continuing with the sport and progressing. Additionally, prolonged exposure of the individual to the shock and/or vibrations generated by existing racquet handle designs could lead to injury, such as stress fractures and the like.

Consequently, there exists in the art a long-felt need for an improved racquet handle that is relatively flexible and that enables a user to impart greater force on a ball, such as a tennis ball, with a racquet, thereby improving the user's play and making the game more enjoyable. There also exists in the art a long felt need for an improved racquet handle that dampens or reduces the amount of vibration and/or shock otherwise imparted to an individual holding a racquet when the racquet strikes the ball, thereby reducing the likelihood of injury and making the game more enjoyable. Finally, there is a long-felt need for an improved racquet handle that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a flexible racquet design that enables a user to impart greater force on a ball, such as a tennis ball, with the racquet while also dampening or reducing the amount of vibration and/or shock to the individual holding the racquet when the racquet strikes the ball. The improved racquet is preferably comprised of a handle, a racquet head, and at least one relatively flexible insert positioned along said handle and/or between the handle and the racquet head. Flexible insert is preferably comprised of a flexible material such as rubber, reinforced rubber, plastic or the like, and may contain one or more male portions for insertion into corresponding openings in the racquet handle and/or head. Conversely, it is also contemplated that the flexible insert could be comprised of one or more openings for receipt of male portions that may extend from the handle and/or racquet head, or a combination of a male portion and an opening.

The flexible insert of the present invention allows an individual to flexibly or pivotally connect a racquet handle with a racquet head, or a first portion of a racquet handle with a second portion of a racquet handle so as to enable a user to impart greater force on a ball with the racquet, while also dampening or reducing the amount of vibration and/or shock to the individual holding the racquet when the racquet strikes the ball. The improved racquet handle of the present invention also enables a user to pivotally attach different racquet heads to a racquet handle, thereby enabling the user to employ racquet heads with different shapes and sizes without incurring the expense and storage requirements associated with owning multiple racquets. Finally, the improved racquet handle device of the present invention accomplish all of the forgoing objectives and is relatively inexpensive to manufacture, and safe and easy to use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

Figure 1:
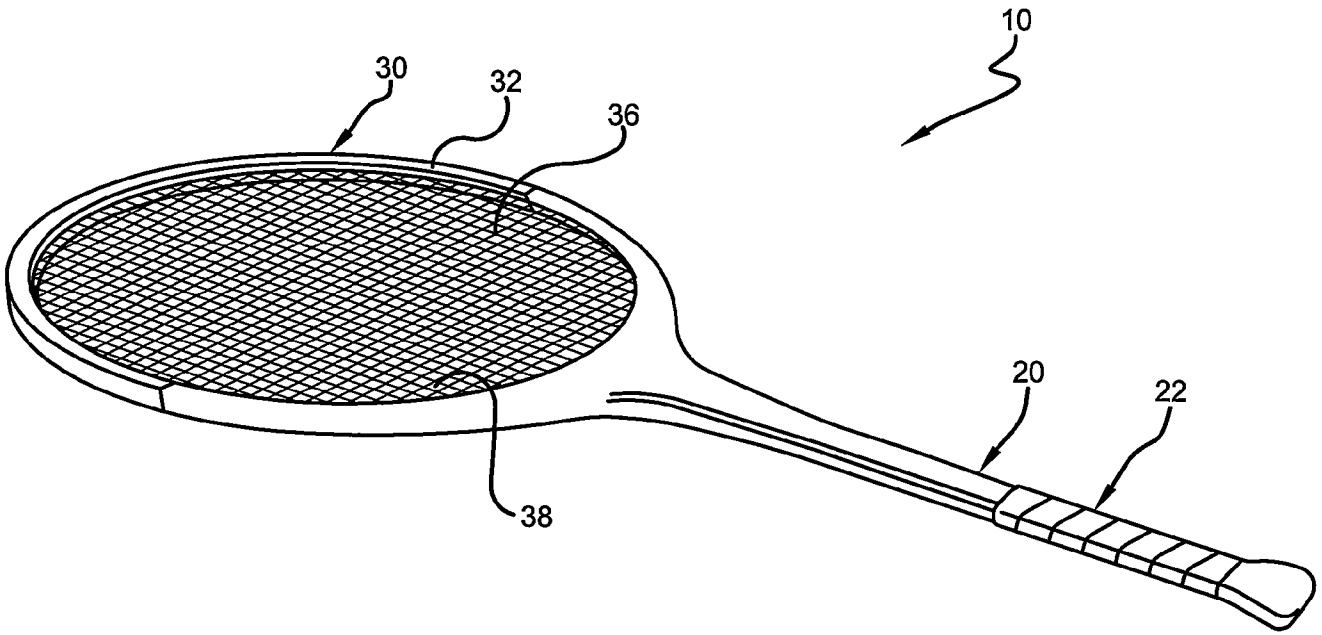
FIG. 1 illustrates a perspective view of a prior art racquet.

The above referenced FIGS. are not necessarily to scale, but are offered for illustrative purposes.

DETAILED DESCRIPTION

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 illustrates a perspective view of a prior art racquet 10. Racquet 10 can be any type of racquet that is known in the art, such as a tennis racquet, racquetball racquet, badminton racquet, etc. Racquet 10 typically comprises a handle 20 and a racquet head 30 that is either integrally formed at one end of said handle 20, or securely attached thereto. Racquet 10 can be comprised of graphite, wood, plastic, fiberglass, metal or other durable material that is well known in the art for manufacturing racquets, and racquet 10 is readily available in most sporting good and department stores.

Racquet handle 20 typically further comprises a grip portion 22, which could be comprised of rubber, tape, or other well known material for improving a user's (not shown) grip on the racquet 10. Racquet head 30 typically comprises a head frame 32 and a plurality of lateral and longitudinal strings 36 strung to span head frame 32 and create interstices or openings 38 framed by said strings 36, as illustrated in FIG. 1. Further, strings 36 are typically under tension to improve the performance of racquet 10, as is well known in the art.

Figure 2:
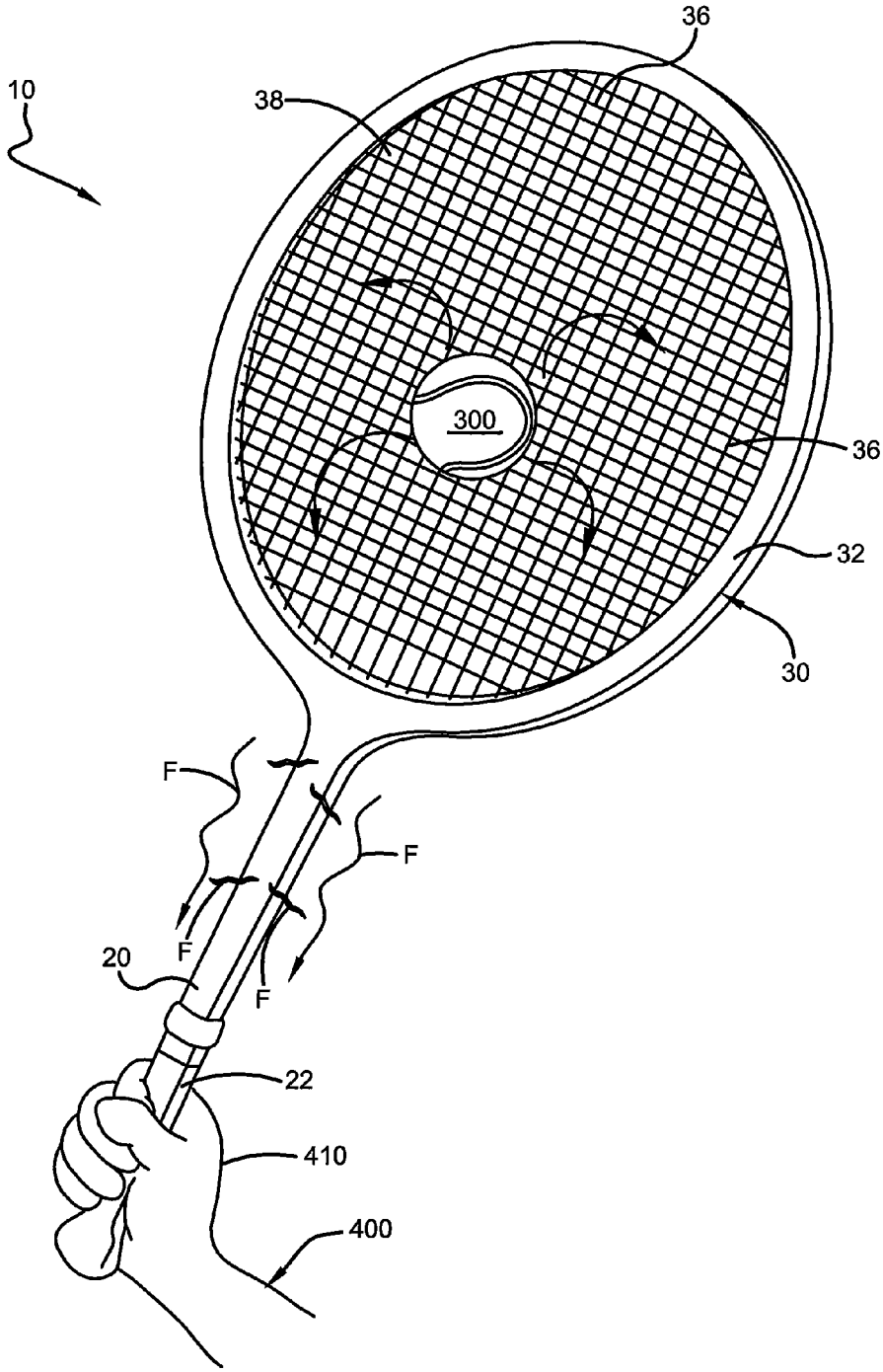
FIG. 2 illustrates a perspective view of a prior art racquet striking a tennis ball with the curved arrows graphically representing the vibration and/or shock generated by the racquet striking the ball being transferred to the user's hand.

FIG. 2 illustrates an individual 400 using a prior art racquet 10 to strike a tennis ball 300. Due to the relatively rigid nature of prior art racquet 10, as strings 36 of racquet 10 make contact with ball 300, a vibration or force F is generated and travels down the length of handle 20 and to the individual's hand 410, which may result in discomfort or possible injury to the individual 400. The resulting discomfort or possibility of injury may, in turn, cause individual 400 to strike ball 300 with less force than the individual is otherwise capable of, thereby impacting the individual's performance and/or enjoyment of the game.

Figure 3:
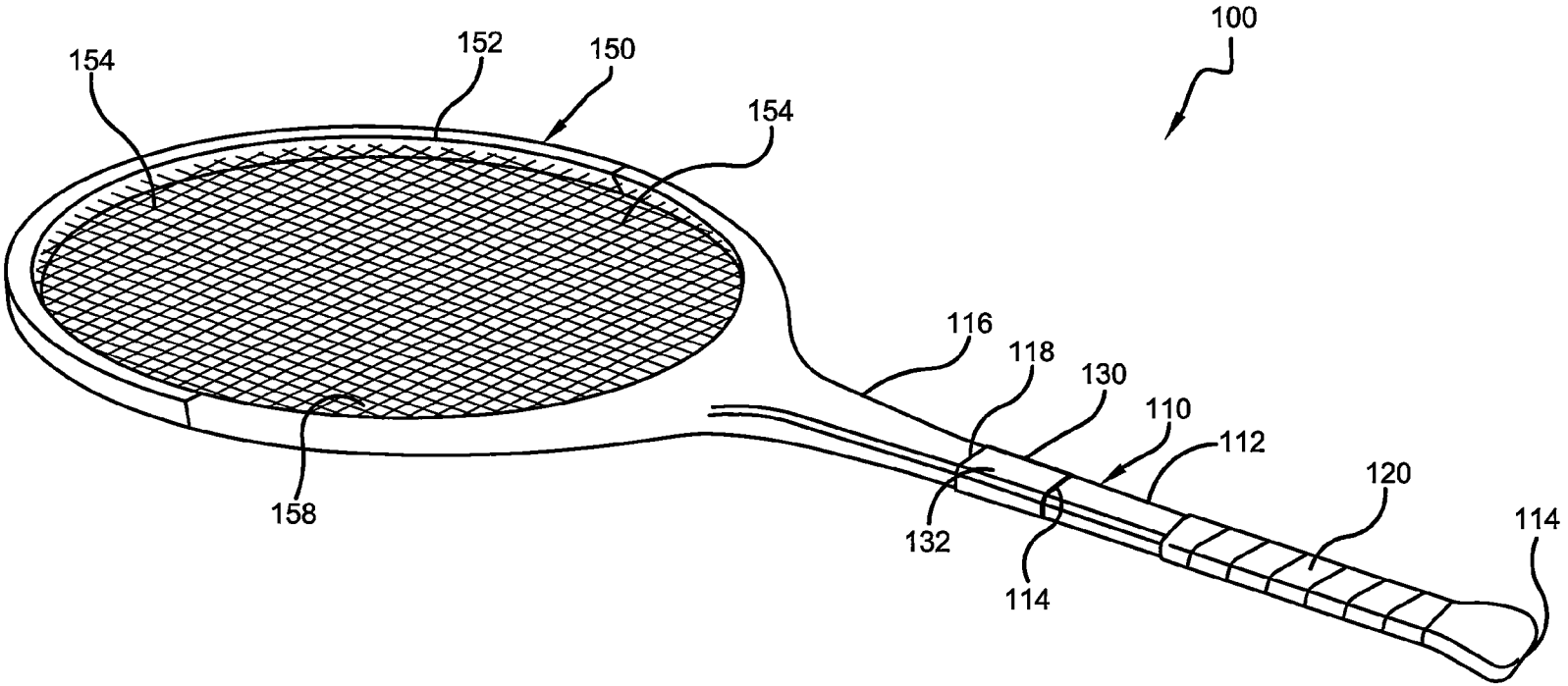
FIG. 3 illustrates a perspective view of a racquet comprised of one embodiment of the improved racquet handle device of the present invention.

Having now described the general structure of prior art racquet 10 and the limitations associated therewith, a racquet 100 with an improved handle 110 will now be described. Referring again to the drawings, FIG. 3 illustrates a perspective view of a racquet 100 comprised of one embodiment of the improved handle 110 of the present invention and a racquet head 150. Unless otherwise stated, racquet 100 may be comprised of graphite, wood, plastic, fiberglass, metal or other durable material that is well known in the art for manufacturing racquets, and may come in various shapes, sizes and colors to suit user preference. Additionally, racquet 100 may be a solid mass or have a hollowed out opening therein (not shown), as is well known in the art for reducing the weight of the racquet and improving performance.

Racquet handle 110 typically further comprises a grip portion 120, which could be comprised of rubber, tape, or other well known material for improving a user's (not shown) grip on the racquet 100. Similar to prior art racquet head 30, racquet head 150 typically comprises a head frame 152 and a plurality of lateral and longitudinal strings 154 strung to span head frame 150 and create interstices or openings 158 framed by said strings 154, as illustrated in FIG. 3. Further, strings 154 are typically under tension to improve the performance of racquet 100, as is well known in the art.

In a preferred embodiment of the present invention, which is depicted in FIG. 3, handle 110 is preferably comprised of a first portion 112 with opposing ends 114, a second portion 116 also with opposing ends 118, and a relatively flexible insert 130 positioned between and connecting said first and second portions 112, 116. First portion 112 is a generally elongated member that is preferably between 7½ and 10½ inches in length, as measured between opposing ends 114, and the overall circumference of first portion 112 is preferably between 4 and 5 inches to accommodate the hand sizes of most users. Notwithstanding, it is contemplated that other sizes could also be used without affecting the overall concept of the present invention.

First portion 112 may further comprise a grip portion 120 located near a first end 114 of first portion 112, which may be comprised of rubber, tape, or other well known material for improving a user's (not shown) grip on racquet 100. As described more fully below, end 114 opposite of grip 120 may be further comprised of an opening 115 therein for removably and flexibly connecting first portion 112 to flexible insert device 130.

Second portion 116 is also a generally elongated member that is preferably between one and two inches in length, as measured between opposing ends 118, and the overall circumference of second portion 116 is preferably between 4 and 5 inches. As described more fully below, a first end 118 of second portion 116 may further comprise an opening 119 therein for removably and flexibly connecting second portion 116 to flexible insert device 130, and the opposing end 118 of second portion 116 may be attached to, or integrally formed with, racquet head 150.

Insert device 130 is preferably formed of a flexible material such as rubber, reinforced rubber, plastic or the like, and may comprise a body portion 132 further comprised of a first end 1322 and a second end 1326. Flexible insert 130 may further comprise a male portion 136 extending outwardly from both of said first end 1322 and said second end 1326 for insertion into openings 115, 119, respectively. Conversely, it is also contemplated that insert 130 could be comprised of one or more openings (not shown) in said first and second ends 1322, 1326 for receipt of male portions (not shown) that may extend from the handle 110 and/or racquet head 150, or a combination of a male portion and an opening.

Inserts 130 can be manufactured with different degrees of flexibility to suit user need and/or preference. In this manner, as a user progresses in his or her development as a player, the user can increase or decrease the flexibility of his or her racquet handle by using inserts 130 with different degrees of flexibility with the same racquet handle, as opposed to having to purchase a new racquet and/or handle each time the user desires to make a change to the flexibility of the racquet handle.

In a preferred embodiment of the present invention, the size and cross-sectional shape of body portion 132 should compliment the general size and cross-sectional shape of handle 110 so as to not interfere with the user's grip on handle 110. Additionally, with respect to a tennis racquet, insert device 130 is preferably located along said handle 110 approximately one to two inches away from racquet head 150, and more preferably 1½ inches away from said racquet head 150. By comparison, with respect to a racquetball racquet, insert device 130 is preferably located along said handle 110 immediately adjacent to racquet head 150. Notwithstanding, it is also contemplated that insert device 130 could be positioned at other locations along handle 110 to suit user need and/or preference.

Further, the size and shape of male portion 136 extending outwardly from one or more of said first end 1322 and said second end 1326 should correspond with the general size and shape of openings 115, 119, respectively, so as to friction fit therewithin. Once assembled, first portion 112 of handle 110 will be securely attached to second portion 116 of handle 110, but insert device 130 will serve as a flex or pivot point that provides racquet head 150 with greater flexibility than prior art racquet 10, which is typically integrally formed without a flex or pivot point. The increase in flexibility allows more pivotal movement of racquet head 150 relative to racquet handle 110 during a typical swing, which results in greater force being imparted to ball 300. The increased flexibility also absorbs more of the shock present along a racquet handle when the racquet makes contact with the ball 300.

Figure 4:
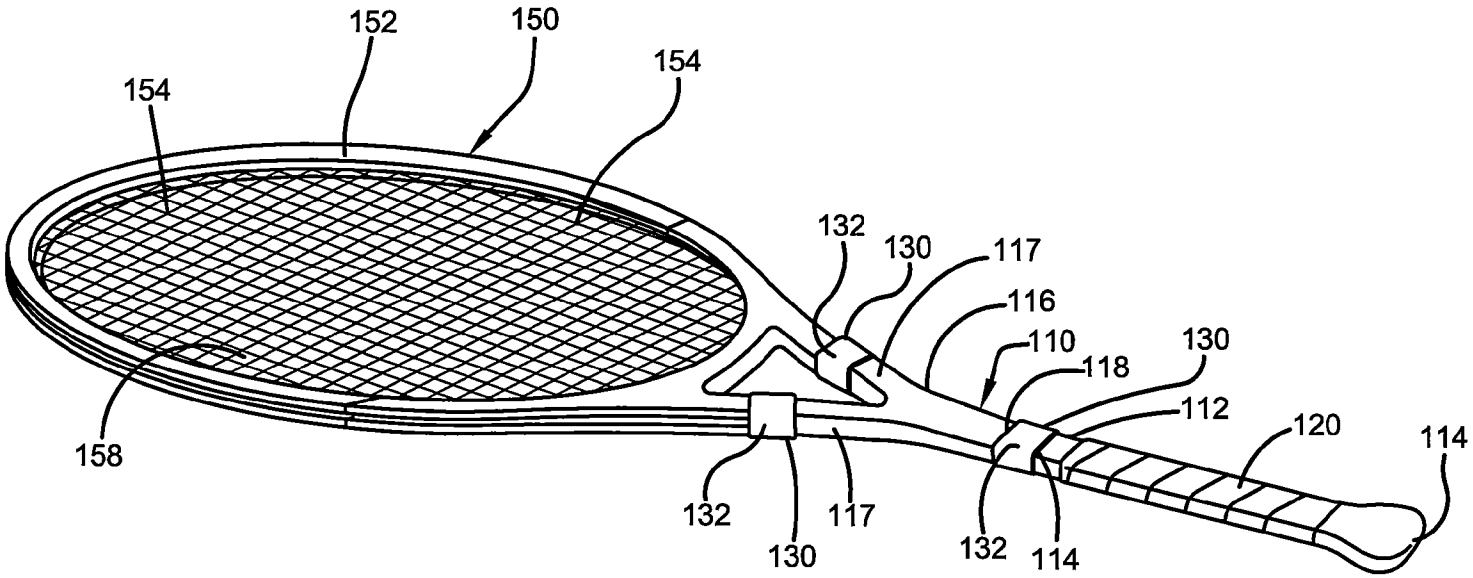
FIG. 4 illustrates a perspective view of a racquet comprised of an alternative embodiment of the improved racquet handle device of the present invention.

FIG. 4 illustrates a perspective view of a racquet comprised of an alternative embodiment of the second portion 116, which is further comprised of side posts 117. More specifically, an insert device 130 may be positioned along one or both of side posts 117, as well as between first portion 112 and second portion 116. As stated above, the size and cross-sectional shape of body portion 132 of insert device 130 should compliment the general size and cross-sectional shape of side posts 117 so as to not interfere with the user's handling of racquet 100.

Figure 5:
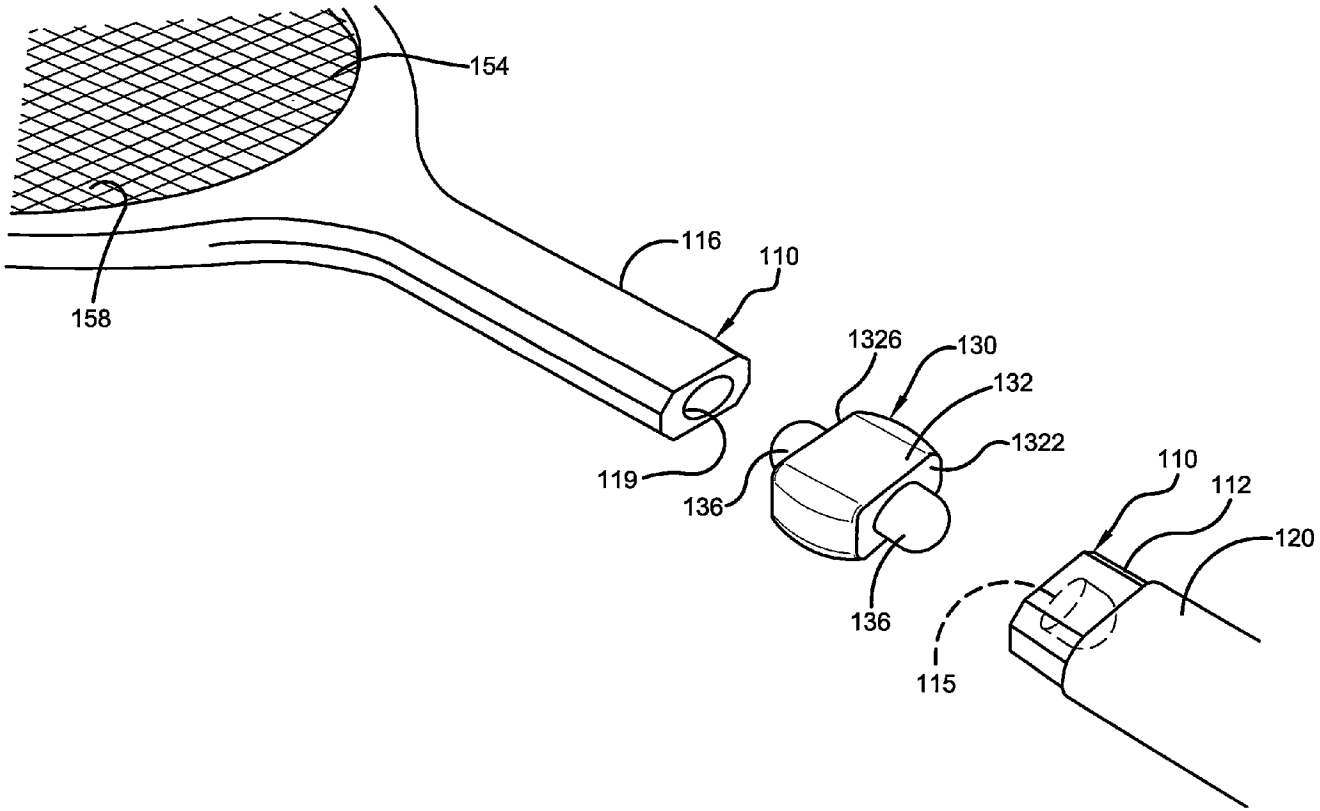
FIG. 5 illustrates a partial perspective exploded view of one embodiment of the improved racquet handle device of the present invention.

FIG. 5 depicts a partial perspective exploded view of the embodiment of the improved racquet handle device of FIG. 3. As illustrated in FIG. 5, insert device 130 is comprised of a body portion 132, which is further comprised of a first end 1322 and a second end 1326, and a male portion 136 extending outwardly from both of said first end 1322 and said second end 1326 for insertion into openings 115, 119, respectively. Conversely, and as stated above, it is also contemplated that insert 130 could be comprised of one or more openings (not shown) in said first and second ends 1322, 1326 for receipt of male portions (not shown) that may extend from the handle 110 and/or racquet head 150, or a combination of a male portion and an opening.

It should also be appreciated that the structure of the improved racquet handle 110 and the insert device(s) 130 also permit the user to use the improved racquet handle 110 with a plurality of interchangeable racquet heads 150. More specifically, a user desiring to use a different racquet head could simply remove the existing racquet head by, for example, disconnecting the second portion 116 from the first portion and inserting male portion of insert device 130 into the opening 119 in the second portion 116 of the replacement racquet head 150. In this manner, a user may experience the benefits of utilizing many different shapes, sizes and types of racquet heads 150 without incurring the expense and storage requirements associated with owning multiple racquets 100. It is also contemplated that a racquet head typically associated with badminton or racquetball could also be attached to a tennis racquet handle in the above described manner, and vice versa.

Figure 6:
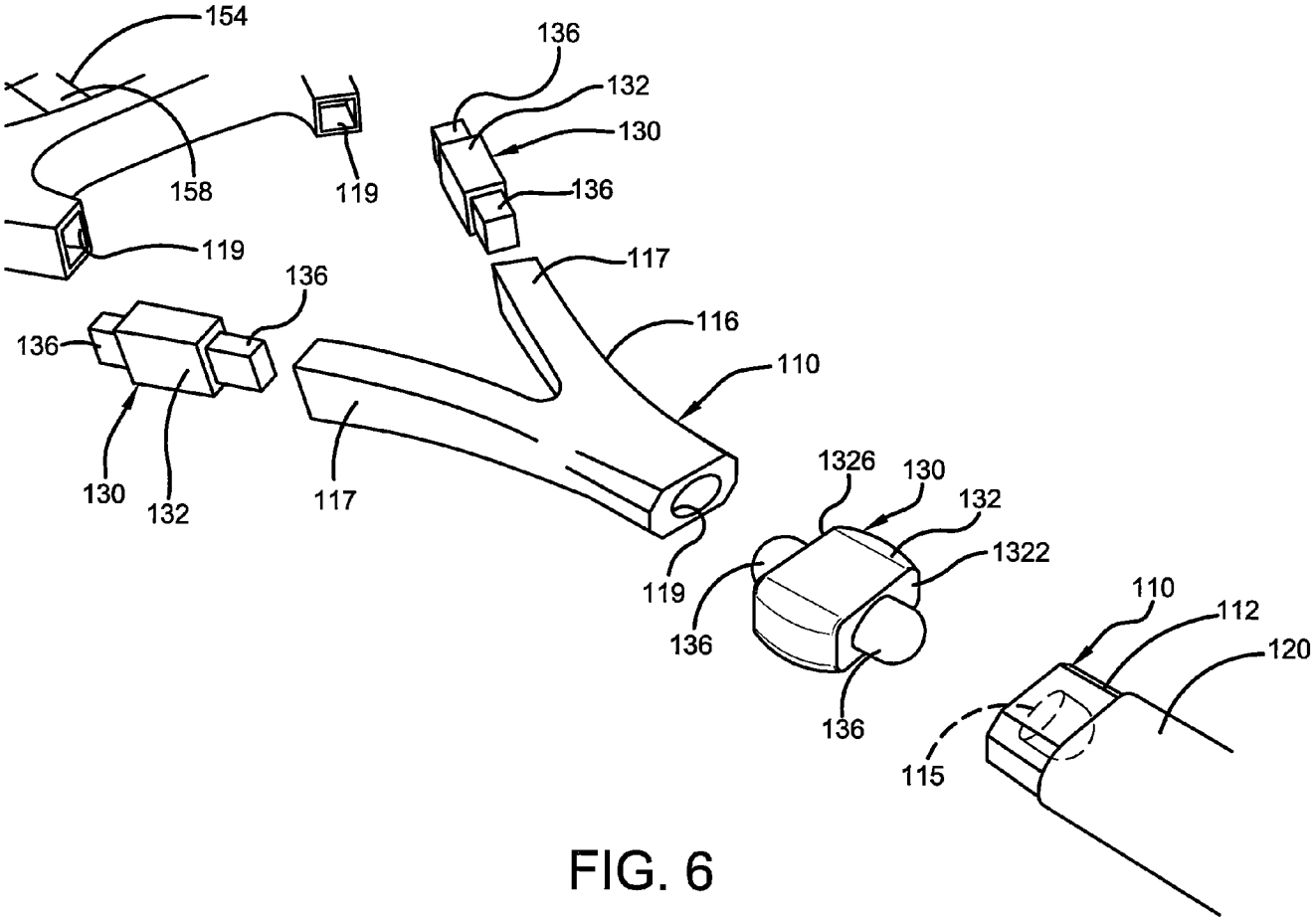
FIG. 6 illustrates a partial perspective exploded view of an alternative embodiment of the improved racquet handle device of the present invention.

FIG. 6 depicts a partial perspective exploded view of the embodiment of the improved racquet handle device of FIG. 4. As illustrated in FIG. 6, an insert device 130 is positioned between first portion 112 and second portion 116 to form a first pivot point, and additional insert devices 130 are positioned along side posts 117 to form a second pivot point in a similar manner.

Consequently, improved racquet 100 includes a racquet handle that is relatively flexible and that enables a user to impart greater force on a ball, such as a tennis ball, thereby improving the user's play and making the game more enjoyable. The improved racquet handle and flex point(s) located thereon also dampens or reduces the amount of vibration and/or shock otherwise imparted to an individual holding a racquet when the racquet strikes the ball, thereby reducing the likelihood of injury and making the game more enjoyable. Additionally, the structure of the improved racquet handle and the insert device(s) permit the user to use the improved racquet handle with a plurality of interchangeable racquet heads, thereby sparing the user the expense and storage requirements associated with owning multiple racquets. Finally, the improved racquet is relatively inexpensive to manufacture, and safe and easy to use.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An improved racquet handle comprising:

a first portion and a second portion; and at least one insert comprised of rubber and positioned along said improved racquet handle;

wherein said first portion is removably attached to said second portion by said at least one insert; and wherein said at least one insert comprises a first male portion for insertion into an opening in said first portion, and a second male portion for insertion into an opening in said second portion; and wherein said at least one insert is interchangeable with at least one other insert, and wherein said at least one insert has a differing degree of flexibility than that of said at least one other insert.

2. An improved racquet handle comprising:

a first portion and a second portion, wherein said second portion is further comprised of two side posts; and at least one insert comprised of rubber;

wherein said first portion is removably attached to said second portion by said at least one insert, and wherein at least one additional insert is positioned along a first side post and at least one other additional insert is positioned along a second side post; and wherein said at least one insert comprises a first male portion for insertion into an opening in said first portion, and a second male portion for insertion into an opening in said second portion; and wherein said at least one insert is interchangeable with at least one other insert, and wherein said at least one insert has a differing degree of flexibility than that of said at least one other insert.

3. The improved racquet handle of claim 2 comprised of three inserts, wherein a first of said three inserts is positioned between the first portion and the second portion, a second of said three inserts is positioned along a first one of said two posts, and a third of said three inserts is positioned along a second one of said two posts.

4. An improved racquet handle comprising:

a first portion;

a second portion; and a pivot point comprised of rubber and positioned between the first portion and the second portion;

wherein said first portion is removably attached to said second portion by said pivot point; and wherein said pivot point comprises a first male portion for insertion into an opening in said first portion, and a second male portion for insertion into an opening in said second portion; and wherein said pivot point is interchangeable with at least one other pivot point, and wherein said pivot point has a differing degree of flexibility than that of said at least one other pivot point.

5. The improved racquet handle of claim 4 wherein said racquet handle is attached to a racquet head.

6. The improved racquet handle of claim 5 wherein said pivot point enables said racquet head to rotate relative to said racquet handle.

7. The improved racquet handle of claim 4 further comprising at least one additional pivot point.

8. The improved racquet handle of claim 7 wherein said pivot point is in spaced apart relationship along said racquet handle from said at least one additional pivot point.

* * * * *